US005743525A

United States Patent [19]

Haddad

[11] Patent Number: 5,743,525

[45] Date of Patent: Apr. 28, 1998

[54] SPORTING EVENT WAGERING SYSTEM

[76] Inventor: George N. Haddad, 275 Victoria St., Costa Mesa, Calif. 92627

[21] Appl. No.: 675,276

[22] Filed: Jul. 1, 1996

[51] Int. Cl.[6] ..... A63F 9/24

[52] U.S. Cl. ..... 273/139; 273/138.1; 463/16

[58] Field of Search ..... 463/1, 16, 17, 463/18, 21, 30, 31, 40, 41, 42, 25, 26; 273/139; 364/410, 412

[56] References Cited

U.S. PATENT DOCUMENTS 5,374,060 12/1994 Goldberg ..... 273/139

*Primary Examiner*—Jessica Harrison
*Assistant Examiner*—Mark A. Sager
*Attorney, Agent, or Firm*—Edward E. Roberts

[57] ABSTRACT

A betting method in which a bettor picks a single digit integer, or number, from a decade of integers, that is, a number from "0" to "9". Predetermined criterion numbers are summed and the least significant digit of the sum is compared to the selected integer to determine winners. For example, event entrants, such as horses, are assigned different numbers, whether single or double digit, for a particular race, so that no two horses in the same race have the same number. The system includes adding the numerical values of the numbers of the winning positions of the entrants (typically first, second and third), with the least significant digit of the sum or total being compared with the bettor's selected number, and on occurrence of a match, the bettor wins, the amount of the winnings being taken as a percentage of the pool of wages of like bettors for the same event, divided by the number of winning bettors.

11 Claims, No Drawings

SPORTING EVENT WAGERING SYSTEM

BACKGROUND OF THE INVENTION

The background of the invention will be discussed in two parts.

1. Field of the Invention

This invention relates to a wagering system, and more particularly to a sporting event wagering system, such as horse racing by way of example.

2. Description of the Prior Art

Sporting event wagering is very popular, but in most instances, such wagering requires an extensive knowledge of the sport and the "odds" involved in such sporting contests. This is particularly true of sporting events in which there are a relatively large number of participants, with only one winner, such as in horse racing. As used here in a relative sense, the term "large" refers to a number of participants greater than some number, such as five, and less than some number, such as twenty-five.

For example, horse races would typically field a number of horses between five and twenty, depending on the type of race and obviously, the track size.

In horse racing, "odds" sheets are available to the devoted race fan setting forth the probability of success of any given horse winning in a particular race, with the returns on the wager being determined by such odds, and the relative position of the horse at the conclusion of the race, that is, first, second or third, these positions being typically designated "win", "place" or "show".

In short, wagering can be effected not only for a "win", but a "place" or "show" position for any given horse. A bettor can wager on a horse to "show", in which event the bettor wins if the horse finishes in any of the top three positions, with the amount of the payoff being determined by the "odds" for each of the three positions.

For example, the odds on a particular horse may be posted at 20 to 1 to win with the payoff for second and third being posted as 6 to 1 and 3 to 1. Wagering at the track is normally in denominations of two dollar bets, with payoff being determined by the odds and the finish position wagered.

Other wagers are available, such as "daily doubles" or "triples", in which a bettor picks a horse from each of a number of different races, such as three races, for example, with the wager taking place before the start of the first of the three consecutive races. If the bettor picks the correct horse to win in all three races, the payoff is high.

In any event, for a bettor to have a reasonable probability of winning, knowledge of the race entrants, the jockeys, the condition of the track, the condition of the horse, the past records of both the horse and jockey for similar events, and other factors must be considered for each wager.

For the novice or amateur, such factors can be intimidating, and thus reduce the possibility for such novices wagering to any great extent. Since betting is a major part of the enjoyment of racing for many fans, the novice or new fan has needed a wager that is less demanding of specialized knowledge.

Further, horse owners and race track operators are dependent on betting for a large source of their revenue and are in need of betting systems which increase the betting revenues, as well as attract new fans.

Accordingly, it is a feature of this invention to provide a sporting event wagering system, and more particularly a horse race betting system which requires little knowledge on the part of the bettor, while providing a reasonable possibility of winning.

SUMMARY OF THE INVENTION

The foregoing and other objects of the invention are accomplished by providing a betting method in which a bettor picks a single digit integer, or number, from a decade of integers, that is, a number from "0" to "9". Race entrants, such as horses, are assigned different numbers, whether single or double digit, for a particular race, so that no two horses in the same race have the same number.

The system includes adding the numerical values of the numbers of the winning positions of the race horse entrants (typically first, second and third), with the least significant digit of the sum or total being compared with the bettor's selected number, and on occurrence of a match, the bettor wins, the amount of the winnings being taken as a percentage of the pool of wagers of like bettors for the same race, divided by the number of winning bettors. This is a typical "win pool" payoff.

DESCRIPTION OF THE PREFERRED EMBODIMENT

In accordance with the preferred embodiment, the system includes a wagering system which evolves around a single integer or digit from "0" to "9". The bettor picks a digit or number from "0" to "9" and places a bet on this number for a given race. In horse racing, each horse is provided with a unique number for the race, that is, no two horses in a given race have the same number.

There is, however, an occasional exception, and that is when an owner starts more than one horse in the same race. In this case, the additional entry, or entries, will be given the same number with a letter suffix added to the number, such as "1A", "1B", etc., wherein a horse numbered "1" is already in the race. However, if this be the case, only the one entrant "1A" will be used in determining the winning integer, i.e., "1B", etc. will be ignored regardless of how they place. All horse numbers, with suffix as appropriate, are affixed to the saddle cloth of the particular horse in the race.

The method of determining the success of the bettor, or the winning integer, is to sum the numbers of the three horses taking the first three positions at the finish line, that is the first, second and third place winners in the race. The odds of winning on a particular digit are a function of the number of horses in the race, and the numbers on the saddle cloths of the horses in the race.

In some races, a particular horse number may be a "scratch" at the last minute before the race, that is, for whatever reason, that horse is not racing in that race. Obviously, if there are fewer than ten horses in a race, not all of the consecutive numbers will be present in the race entrants or participants and the odds are thereby different for a particular integer.

By way of example, for a given number of horses in a given race, the following table represents the possible combinations for any given digit winning in a given race, where the upper row of numbers represents the integer selected for wagering, and the lower row represents the number of times in ten (the number of possible combinations) that integer will result from the summation of the digits of the first three winning race positions:

5 horses (numbered 1–5)
10 different combinations

| 0 | 1 | 2 | 3 | 4 | 5 | 6 | 7 | 8 | 9 |
|---|---|---|---|---|---|---|---|---|---|
| 2 | 1 | 1 | 0 | 0 | 0 | 1 | 1 | 2 | 2 |

By reference to the above table, and by way of example, it is noted that for five race horses wearing numbers 1–5, the integers "3", "4" and "5" have no possibility or probability of winning. The reason for this is that there are no combinations of three numbers, 1 through 5, which add up to a sum ending in 3, 4, or 5, and hence not all of the ten possible integers from "0" to "9" are offered for wager in that particular race.

Further, a given race track may have a particular way of numbering the horses in races comprising fewer than ten entrants.

Other possibilities are:

6 horses (numbered 1–6)
20 different combinations

| 0 | 1 | 2 | 3 | 4 | 5 | 6 | 7 | 8 | 9 |
|---|---|---|---|---|---|---|---|---|---|
| 3 | 3 | 3 | 2 | 1 | 1 | 1 | 1 | 2 | 3 |

In the above table, the numbers in the lower row represent the number of chances in twenty (the total number of different possible combinations) of a particular integer that will result from the summation of the digits of the first three winning race positions. Note that the sum of the numbers in the lower row total "20".

For other numbers of entrants, the following tables show the possibilities of winning by wagering a particular integer:

7 horses (numbered 1–7)
35 different combinations

| 0 | 1 | 2 | 3 | 4 | 5 | 6 | 7 | 8 | 9 |
|---|---|---|---|---|---|---|---|---|---|
| 4 | 4 | 5 | 4 | 4 | 3 | 3 | 2 | 3 | 3 |

8 horses (numbered 1–8)
56 different combinations

| 0 | 1 | 2 | 3 | 4 | 5 | 6 | 7 | 8 | 9 |
|---|---|---|---|---|---|---|---|---|---|
| 5 | 6 | 6 | 6 | 6 | 6 | 6 | 5 | 5 | 5 |

9 horses (numbered 1–9)
84 different combinations

| 0 | 1 | 2 | 3 | 4 | 5 | 6 | 7 | 8 | 9 |
|---|---|---|---|---|---|---|---|---|---|
| 8 | 8 | 9 | 8 | 9 | 8 | 9 | 8 | 9 | 8 |

10 horses (numbered 1–10)
120 different combinations

| 0 | 1 | 2 | 3 | 4 | 5 | 6 | 7 | 8 | 9 |
|---|---|---|---|---|---|---|---|---|---|
| 12 | 12 | 12 | 12 | 12 | 12 | 12 | 12 | 12 | 12 |

It is to be noted that in the case where there are ten race horse entrants, the probability with respect to any given integer is identical to that for any other integer, that is, there are statistically equal odds of winning for any given number.

As additional examples, following are tables for 11, 12, and13 horse races.

11 horses (numbered 1–11)
165 different combinations

| 0 | 1 | 2 | 3 | 4 | 5 | 6 | 7 | 8 | 9 |
|---|---|---|---|---|---|---|---|---|---|
| 17 | 16 | 17 | 16 | 17 | 16 | 17 | 16 | 17 | 16 |

-continued 12 horses (numbered 1–12)
220 different combinations

| 0 | 1 | 2 | 3 | 4 | 5 | 6 | 7 | 8 | 9 |
|---|---|---|---|---|---|---|---|---|---|
| 22 | 22 | 22 | 22 | 22 | 22 | 22 | 22 | 22 | 22 |

13 horses (numbered 1–13)
286 different combinations

| 0 | 1 | 2 | 3 | 4 | 5 | 6 | 7 | 8 | 9 |
|---|---|---|---|---|---|---|---|---|---|
| 29 | 28 | 29 | 28 | 29 | 28 | 29 | 28 | 29 | 28 |

The above tables are representative and other tables can be derived for any other number of race horse entrants for a given race. The combinations shown can be used by the bettor to compare to races in which a horse (or some horses) are scratched and the missing number(s) causes a variation or skewing of the distribution of possibilities.

By way of example, the following tables illustrate the skewing of the combinations with certain digits removed (or not appearing) in the numbers on the saddle cloths of the race horse entrants.

8 horses to start, Nos. "1" and "4" scratched
(numbered 2,3,5,6,7,8)

| 0 | 1 | 2 | 3 | 4 | 5 | 6 | 7 | 8 | 9 |
|---|---|---|---|---|---|---|---|---|---|
| 2 | 2 | 1 | 2 | 2 | 3 | 3 | 2 | 2 | 1 |

The skewing of the results can be best shown by comparison of the above table with a copy of the table below, which has been previously depicted, where there are six original starters in the race and none are scratched.

In both instances there are still 6 horses racing and still twenty possible combinations (or possibilities), but the probability with respect to a particular integer has changed. Taking the integer "1" for example, in the above table, there are two chances out of twenty, while in the table below, there are three chances out of twenty.

Also with respect to the integers "2" and "9", the chances have been cut to one-third of that with six original entrants with no "scratches". The actual variation will of course be determined by which integers or numbers have been "scratched" for a given race.

6 horses (numbered 1–6)
20 different combinations

| 0 | 1 | 2 | 3 | 4 | 5 | 6 | 7 | 8 | 9 |
|---|---|---|---|---|---|---|---|---|---|
| 3 | 3 | 3 | 2 | 1 | 1 | 1 | 1 | 2 | 3 |

For betting or wagering purposes, there are many different methods by which the wagering system may be employed.

In a first instance, the bettor selects a single digit, or number, from "0" to "9", and places a wager with the track. After the race, the saddle cloth numbers of the horses finishing first, second and third, are summed or totaled. If the last digit of the total is the same as the number selected, the bettor wins.

By way of example, if the selected number is "2", and the horses finishing in the first three positions are numbered "5", "6" and "1", the total is 12. The only number of significance in the total is the least significant digit, that is "2", and therefore the bettor wins.

In a variation of this method, betting may be permitted over a number of races, such as three. In this event the bettor selects a number, and the saddle cloth numbers are summed for the horses finishing first in each of the three races. If the last digit of the total is the same as the number selected the bettor wins. The same can be done with any number of races, and correspondingly, the track payoff could be greater for a larger number of races.

If there is a dead heat, that is, a tie for the first place finishers, or the second place finishers, there are three numbers for those horses to add up or total. However, in the event there is a tie for the "show" or third place position, this results in four horses instead of three. In this event, two numbers are computed and used for purposes of determining winning wagers. The saddle cloth numbers of the first two finishers are totaled, and this sum is then individually added to each of the two third place finishers, thereby resulting in two sets of winners for the same race.

In accordance with the present wagering method, less handicapping skill, experience or knowledge is required of the bettor. The present sporting event wagering system may be readily utilized in any number of sporting events or contests in which there are a significant numbers of entrants competing against each other in a given race or event, with each entrant having an identifying number. Betting success can be determined by the first three finishers, combining the scores of the contestants, or other desired combinations. Examples are auto racing, football games, tennis matches, etc.

It is to be understood that various other adaptations and modifications may be made without departing from the spirit and scope of the invention.

What is claimed is:

1. A method of wagering on a sporting or racing event having a plurality of entrants, said method comprising:

selecting a number between zero and nine prior to the event;

wagering on the selected number:

at conclusion of the event, adding predetermined criterion numbers of the entrants to obtain a sum; and comparing the least significant digit of said sum thus obtained with the selected number to determine the outcome of the wager.

2. The method of claim 1 wherein said predetermined criterion number of each said entrant is a unique identifying number which numbers are selected for summing depending upon the preselected finishing position of said entrant in said event.

3. The method of claim 2 wherein said event is a race and said preselected positions are the first, second and third finishing positions.

4. The method of claim 1 wherein said event is a contest between at least two entrants and said predetermined criterion number for each entrant is their final score.

5. A method of wagering on a sporting or racing event having a plurality of entrants, each with a unique identifying number, said method comprising:

wagering, by a bettor, on a selected number between zero and nine prior to the event;

at conclusion of the event, adding the identifying numbers of the entrants finishing in preselected positions to obtain a sum; and comparing the least significant digit of the sum thus obtained with the bettor's selected number to determine the outcome of the wager.

6. The method of claim 5 further including the step of providing a bettor with a sheet showing the possible combinations of winning associated with a single digit for a given number of entrants in a particular event.

7. The method of claim 6 further including the step of paying to the bettor a sum determined by a pro rata distribution to all bettors with the selected number of a percentage of the total amount of wagers on all bettors betting on a single digit for the event in accordance with this method.

8. The method of claim 7 wherein said sporting event is a horse race and said preselected positions are the first, second and third finishing positions of the horses.

9. A method of wagering on a sporting or racing event having a number of events, each having a plurality of entrants, each entrant having a unique identifying number, said method comprising:

selecting a number between zero and nine prior to the first of the number of events;

wagering on the selected number;

at conclusion of the last of the number of events, adding the identifying numbers of each of the entrants finishing in the first position; and comparing the least significant digit of said sum thus obtained with the selected number to determine the outcome of the wager.

10. The method of claim 9 wherein the number of events equals 3.

11. The method of claim 9 wherein the number of events equals 6.

* * * * *